United States Patent [19]

Erbstoesser

[11] 4,287,952

[45] Sep. 8, 1981

[54] METHOD OF SELECTIVE DIVERSION IN DEVIATED WELLBORES USING BALL SEALERS

[75] Inventor: Steven R. Erbstoesser, Missouri City, Tex.

[73] Assignee: Exxon Production Research Company, Houston, Tex.

[21] Appl. No.: 151,567

[22] Filed: May 20, 1980

[51] Int. Cl.[3] ..... E21B 33/10; E21B 43/26; E21B 43/119

[52] U.S. Cl. ..... 166/284; 166/281; 166/297

[58] Field of Search ..... 166/284, 297, 298, 250, 166/281, 305 R, 285, 292

[56] References Cited

U.S. PATENT DOCUMENTS 2,754,910 7/1956 Derrick et al. ..... 166/284
4,102,401 7/1978 Erbstoesser ..... 166/284
4,160,482 7/1979 Erbstoesser et al. ..... 166/284
4,194,561 3/1980 Stokley et al. ..... 166/284 X

*Primary Examiner*—Stephen J. Novosad
*Attorney, Agent, or Firm*—Robert B. Martin

[57] ABSTRACT

There is disclosed a method for selective diversion in a deviated wellbore comprising generally perforating the casing with a first group of perforations at the top or bottom abutting an imaginary plane which is substantially in the vertical and extends along the longitudinal axis of the casing and perforating the casing with a second group of perforations circumferentially spaced-away from the plane. Diversion is accomplished by injecting buoyant or non-buoyant diverting agents into the casing and transporting them down the casing in a pathway adjacent to the casing and the imaginary plane. The diverting agents bypass the circumferentially spaced-away perforations and seat in at the perforations at the top or bottom of the casing.

11 Claims, 6 Drawing Figures

METHOD OF SELECTIVE DIVERSION IN DEVIATED WELLBORES USING BALL SEALERS

BACKGROUND OF THE INVENTION

1. Field of the Invention

The present invention pertains to methods for selective diversion in a deviated wellbore and in particular, methods of closing a specific group of perforations in a deviated well casing while leaving the remaining perforations in the well casing open and in communication with the formation.

2. Description of the Prior Art

It is common practice in drilling oil and gas wells to deviate the wellbore from the vertical. When the wellbore is intentionally deviated from the vertical, it is called directional drilling. Directional drilling has application in several situations such as: to obtain production from inaccessible locations, such as populated areas, hostile environments, under rivers, etc.; drilling from offshore platforms; and sidetracking a vertical wellbore after the original well drilled into water or downhole problems require abandonment of the lower wellbore.

It is common practice in completing oil and gas wells, including deviated wells, to set a string of pipe, known as casing, in the well and to pump cement around the outside of the casing to isolate the various formations penetrated by the well. To establish fluid communication between each hydrocarbon bearing formation and the interior of the casing, the casing and cement sheath are perforated at the location of each formation. The perforations within each formation are normally made at 0°, 90°, 120 ° and 180° phasing.

At various times during the life of the well, it may be desirable to temporarily or permanently close off a specific group of perforations in a portion of the casing which are communicating with a certain zone or formation. For example, in water injection wells, it is desirable to permanently close off the specific group of perforations communicating with the most permeable zone after the water in that zone has broken through into the production well. Further, in some cases, it may be desirable to temporarily close off the specific group of perforations communicating with a first zone which is adjacent to a water leg while performing a fracturing treatment on a second zone which is located away from the water leg. There are other situations in which it is desirable to selectively close a specific group of perforations communicating with a particular zone while leaving open the remaining perforations in the casing which communicate with other zones.

One prior method of selective diversion is disclosed in U.S. Pat. No. 4,194,561. This method involves the use of placement devices for positioning buoyant ball sealers at a specific location within the wellbore. These devices are equipped with means to prevent the upward migration of the buoyant ball sealers past the placement device. The ball sealers are seated on the perforations by flowing fluid down the casing and through the device. These devices are normally used to selectively close the perforations located at the lowermost region of the casing.

Therefore, there still exists the need for readily enabling the selective closing of a specific group of perforations located anywhere along the length of the casing.

SUMMARY OF THE INVENTION

The method of the present invention enables the selective closing of a specific group of perforations located anywhere along the length of the casing in a deviated wellbore. This specific group of perforations communicates with a particular zone or portion of zone which is desired to be closed off, either temporarily or permanently during the life of the well. The method of the present invention generally involves five steps. The first step involves perforating with a plurality of perforations that specific portion of the casing which extends through the particular zone or portion of the zone which is desired to be closed off. Substantially all of these perforations are positioned at the top or bottom of the casing abutting an imaginary plane which is aligned substantially vertical and extends along the longitudinal axis of the casing. The second step involves perforation of other portions of the casing with a plurality of perforations to enable communication with other zones. These perforations are positioned circumferentially spaced-away from the imaginary plane at a distance sufficient to substantially prevent diverting agents, such as ball sealers or particulate material, which are being transported down the casing in carrier fluid in a pathway adjacent to the casing and to the plane, from seating in these perforations. Preferably, these perforations are circumferentially spaced-away from the plane at an angle of at least about 30°. The third step involves injecting a carrier fluid containing a diverting agent into the casing when it is desired to close off the perforations in that specific portion of the casing. If the casing has been perforated along the top, the diverting agent is selected so that it has a density less than that of the carrier fluid. If the casing has been perforated along the bottom, the diverting agent is selected so that it has a density greater than that of the carrier fluid. The fourth step involves transporting the diverting agent down the casing. Due to the density contrast between the diverting agent and the carrier fluid, the diverting agent is transported down the casing in a pathway adjacent to the top or bottom of the casing and adjacent to the imaginary vertical plane which extends along the longitudinal axis of the casing. As the diverting agent is being transported down the casing, it will bypass the perforations which are circumferentially spaced-away from the imaginary plane due to the distance between the pathway of the diverting agent and the spaced-away perforations. The diverting agent will by-pass the spaced-away perforations even though these perforations are accepting carrier fluid. The fifth step involves flowing the carrier fluid containing the diverting agent through those preselected perforations located at the top or bottom of the casing to cause the diverting agent to seat in those perforations and selectively close off that specific portion of the casing. When the diverting agent is being transported down the casing along the top or bottom of the casing, it will by-pass the spaced-away perforations and seat only in those perforations along the top or bottom of the casing.

BRIEF DESCRIPTION OF THE DRAWINGS

A more thorough disclosure of the advantages of the present invention is presented in the detailed description which follows and from the accompanying drawings in which.

DESCRIPTION OF A PREFERRED EMBODIMENT

Figure 1:
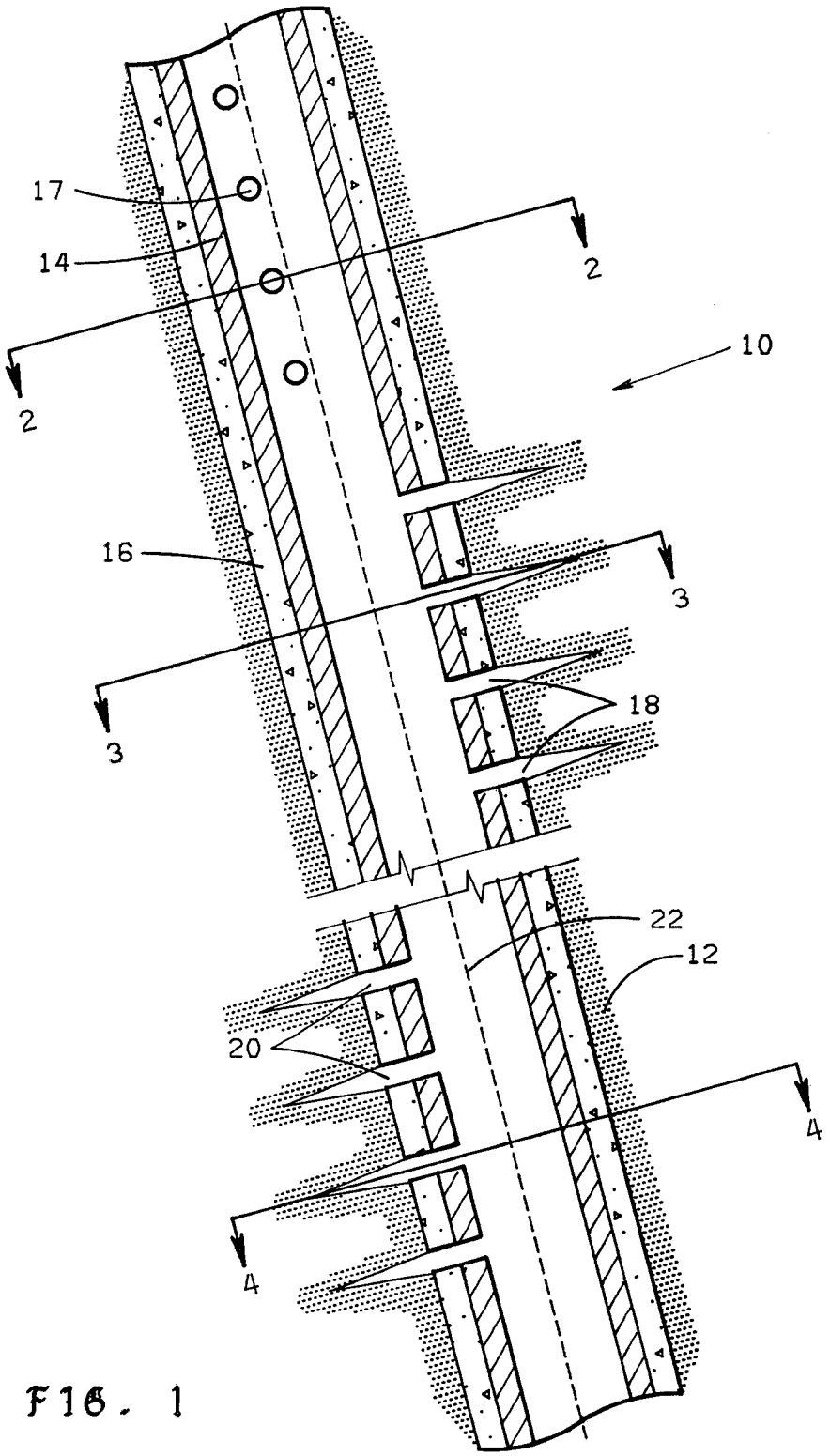
FIG. 1 is a sectional view of a deviated wellbore perforated in accordance with the method of the present invention.

Referring to FIG. 1, there is shown a sectional view of a portion of a deviated wellbore 10 penetrating a subterranean formation 12. A well casing 14 extends through the well and is held in place by cement sheath 16. Casing 14 has longitudinal axis 22 running along the length thereof. To establish fluid communication between the formation and the interior of the casing, the casing and cement sheath are penetrated to provide a plurality of perforations 17 on the side of the casing, perforations 18 at the top of the casing and perforations 20 at the bottom of the casing. During the life of the well, it may be desired to close off perforations 18 or 20.

Figure 2:
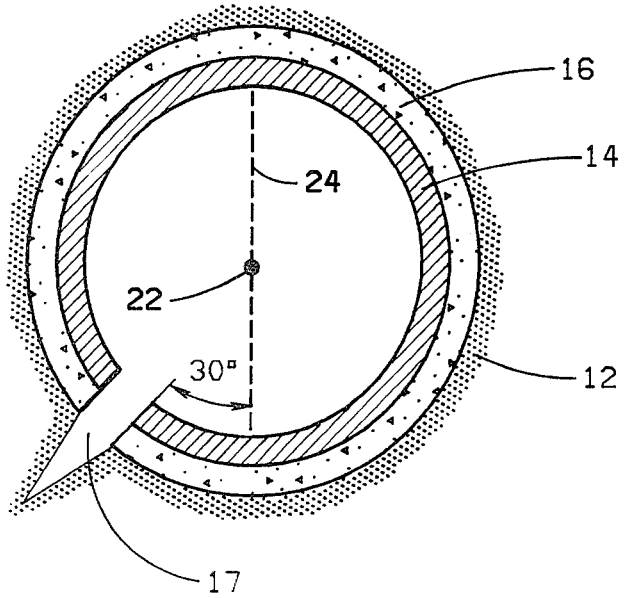
FIG. 2 is a cross-sectional view of the deviated wellbore taken along lines 2—2 of FIG. 1.

Referring to FIG. 2, there is shown a cross-sectional view of casing 14 taken along line 2—2 of FIG. 1. Perforation 17 is positioned on the side of casing 14 and circumferentially spaced-away from the imaginary plane 24 lying substantially in the vertical and extending along the longitudinal axis 22 of casing 14. Perforations 17 are preferably circumferentially spaced-away from plane 24 at an angle of at least about 30°. More preferably, perforations 17 are spaced-away from plane 24 at an angle of from about 60° to about 90°.

Figure 3:
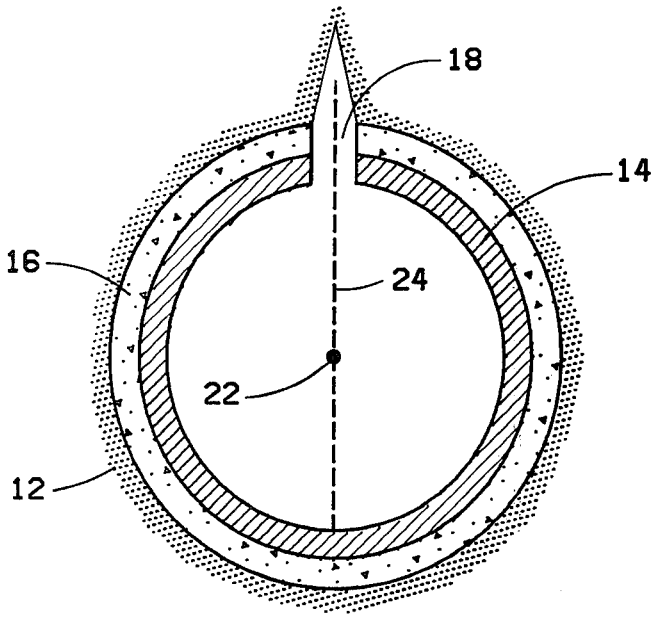
FIG. 3 is a cross-sectional view of the deviated wellbore taken along lines 3—3 of FIG. 1.
Figure 4:
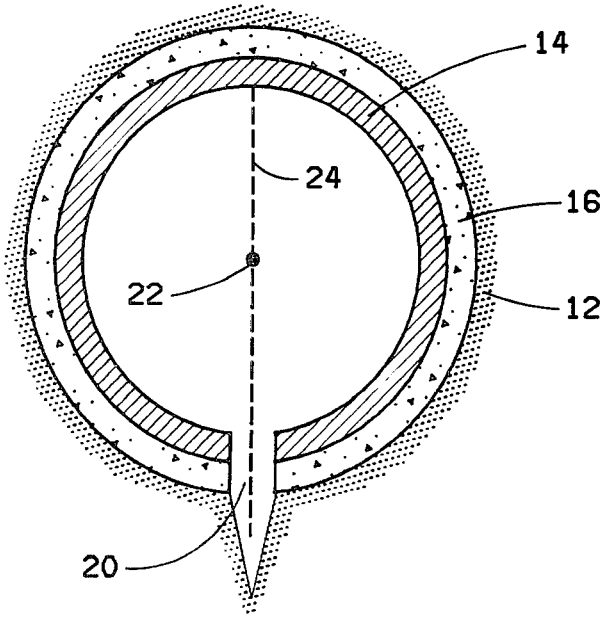
FIG. 4 is a cross-sectional view of the deviated wellbore taken along line 4—4 of FIG. 1.

Referring to FIG. 3, there is shown a cross-sectional view of the casing 14 taken along line 3—3 of FIG. 1. Perforation 18 is positioned at the top of the casing and within the imaginary plane 24. Referring to FIG. 4, there is shown another cross-sectional view of the casing 14 taken along line 4—4 of FIG. 1. Perforation 20 is positioned at the bottom of the casing and within plane 24. It will be obvious to one skilled in the art that in the actual practice of the method of the present invention, the angular circumferential position of perforations 18 and 20 may vary slightly from the vertical but that the casing should be perforated in such a manner so that perforations 18 and 20 abut the plane lying substantially in the vertical.

The remaining portion of the casing (not shown) may be perforated at other locations along its length where it is desired to establish fluid communication with the formation. However, these perforations should be preferably circumferentially spaced-away from plane 24 at an angle of at least about 30°.

The perforations at the top or bottom of the casing may be made by any type of suitable perforating gun. It is preferred to use those perforation guns such as a jet gun which provide the roundest and most burrfree perforations which are most amenable to ball sealer seating. For perforating along the bottom of the casing, any number of mechanical or magnetic type decentralized perforating guns may be utilized. For example, tubing or casing type guns should provide satisfactory perforations. Suitable mechanical type perforating guns utilize leaf springs to orient the gun at the bottom of the casing. The magnetic type perforating gun uses magnets to orient the perforating gun at the bottom of the casing. For perforating along the top of the casing, it is preferred to use similarly decentralized casing perforating guns. These larger guns will minimize the distance between the gun and the wall of the casing to improve the quality of the entrance hole to the perforation. One type of casing gun is disclosed in U.S. Pat. No. 4,153,118; however, it will be obvious to one skilled in the art that other types of perforating guns which can be suitably oriented may also be used in the practice of the method of the present invention.

Figure 5:
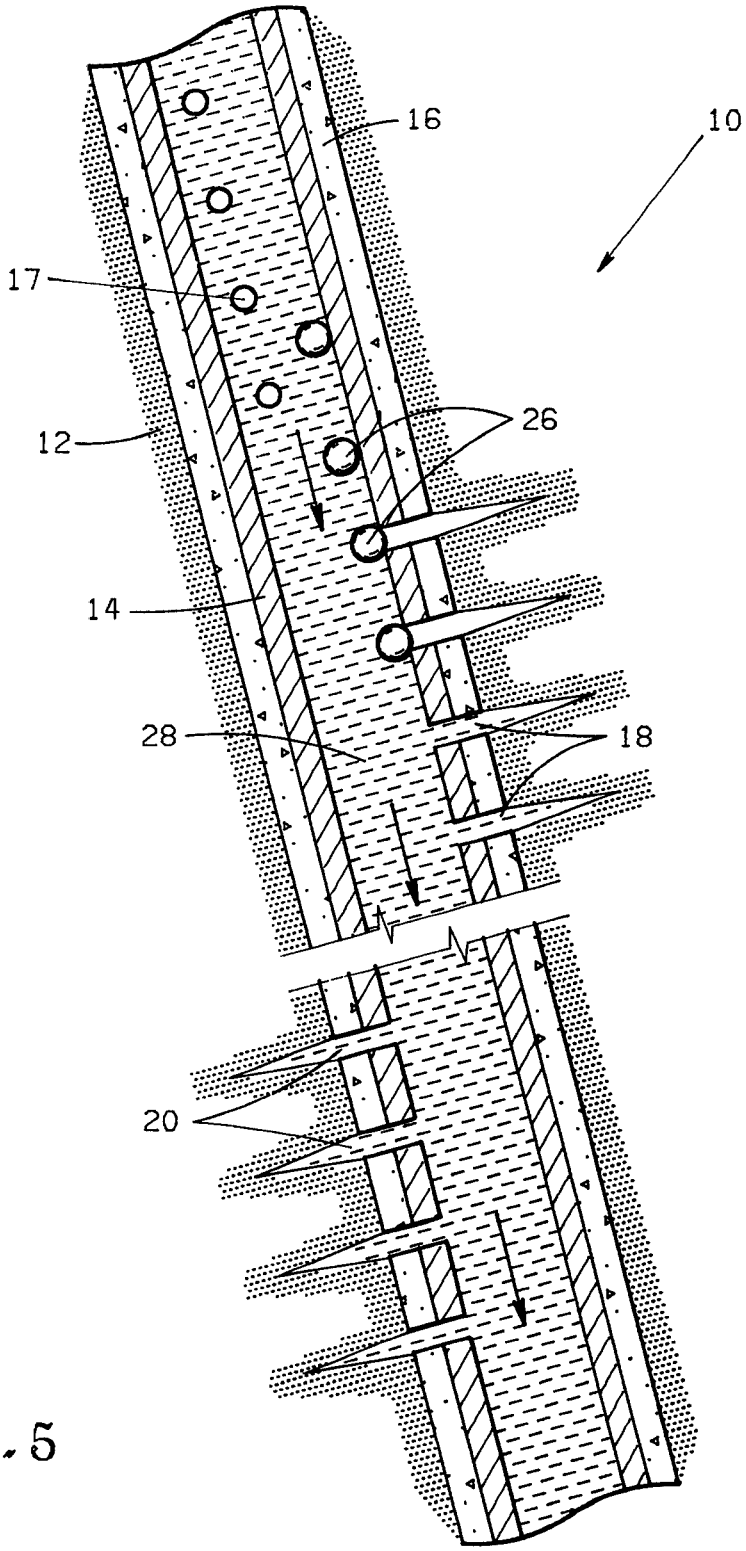
FIG. 5 is a sectional view of the deviated wellbore shown in FIG. 1 with buoyant ball sealers being transported down the casing in accordance with the method of the present invention.
Figure 6:
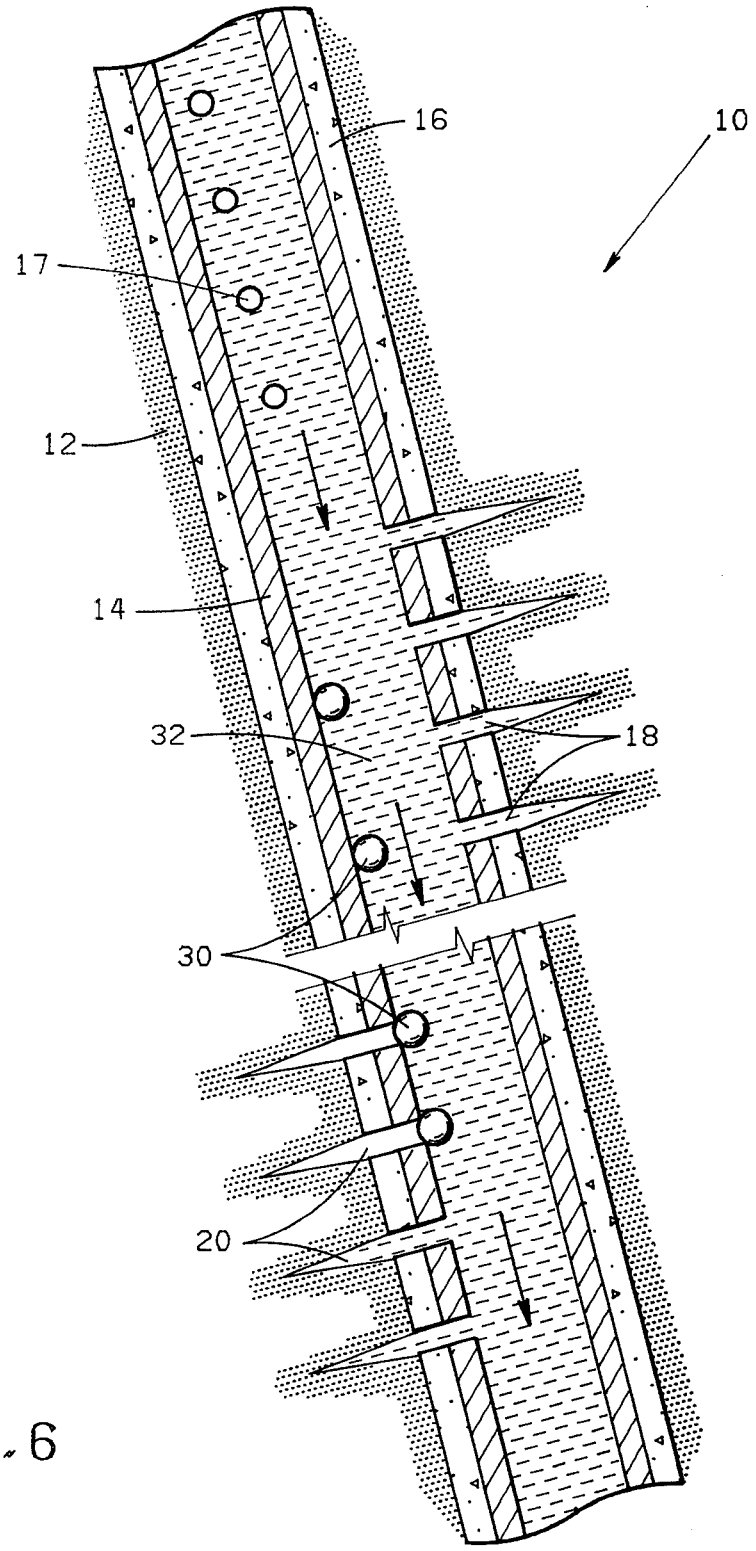
FIG. 6 is a sectional view of the deviated wellbore shown in FIG. 1 with nonbuoyant ball sealers being transported down the casing in accordance with the method of the present invention.

Referring to FIGS. 5 and 6, there are shown ball sealers being transported down a deviated well casing in accordance with the method of the present invention. Referring to FIG. 5, it can be seen that perforations 18 are positioned along the top of the casing 14. Ball sealers 26 have been injected into casing 14 and are being transported down the casing by carrier fluid 28. The ball sealers 26 are selected to have a density less than the density of the carrier fluid 28 which is being used to transport the ball sealers down the casing. The carrier fluid is being injected into the casing at a rate sufficient enough to transport the buoyant ball sealers down the casing. The ball sealers float in the carrier fluid and are transported down the casing in a pathway extending along the top of the casing adjacent to the plane lying substantially in the vertical and extending along the longitudinal axis of the casing 14. The buoyant ball sealers 26 by-pass any perforations located at the bottom of the casing and perforations 17 which are circumferentially spaced-away from the top of the casing 14. Thus, the buoyant ball sealers are transported down the casing until they encounter those perforations positioned at the top of the casing. The flow of fluid through these perforations causes the ball sealers to seat onto those perforations. The ball sealers are held on these perforations by the pressure differential across the perforations.

Referring to FIG. 6, it can be seen that perforations 20 are positioned along the bottom of the casing 14. The ball sealers 30 are selected to have a density greater than the density of the carrier fluid 32. The nonbuoyant ball sealers 30 sink in the carrier fluid 32 and travel down the casing in a pathway extending along the bottom of the casing adjacent to the plane lying substantially in the vertical and extending along the longitudinal axis of the casing 14. These ball sealers by-pass those perforations 17 which are circumferentially spaced-away from the bottom of the casing 14 and perforations 18 which are positioned at the top of casing 14. The ball sealers seat only on those perforations 20 positioned at the bottom of the casing.

In an alternate embodiment of the method of the present invention, the casing may be perforated only at the top and bottom of the casing, thereby enabling both selective diversion and positive selective shut-off of the well. Selective diversion is accomplished by either injecting buoyant or nonbuoyant ball sealers into the well to selectively close off either the perforations at the top of the casing or the perforations at the bottom of the casing. The well may be shut-off by injecting both buoyant and nonbuoyant ball sealers into the casing. If it is only desired to close off one particular zone, the casing can be perforated with a first group of perforations at either the top or bottom of the casing abutting the plane substantially in the vertical. Other portions of the casing can be perforated with perforations circumferentially spaced-away from the first group of perforations at an angle of at least about 30°. For example, if the first group of perforations are positioned at the bottom of casing abutting the plane, the casing may be perforated at the top of the casing circumferentially spaced-away from the imaginary plane at an angle of less than 30°. If the casing is also perforated along the side, the well can be shut-off by injecting ball sealers having a density substantially equal to the density of the carrier fluid.

Several types of diverting agents can be utilized in the practice of the present invention such as ball sealers and particulate material. As noted above, density is the most important factor in selecting a suitable diverting agent for use in the method of the present invention. A diverting agent having a proper density should be selected for use with a specific carrier fluid. If the perforations are positioned at the bottom of the casing, the density of the diverting agent should be greater than the density of the specific carrier fluid which is to be used to transport the diverting agent down the casing. If the perforations are positioned at the top of the casing, the density of the diverting agent should be less than the density of the specific carrier fluid which is to be used to transport the diverting agent down the casing. In the practice of the present invention, it is preferred that ball sealers be used as diverting agents. It is preferred that the ball sealers have an outer covering sufficiently compliant to seal a jet or bullet-formed perforation and have a solid rigid core which resists extrusion through the perforation. One suitable type of ball sealer is disclosed in U.S. Pat. No. 4,102,401. However, it will be obvious to one skilled in the art that many other types of ball sealers can also be utilized in the practice of the method of the present invention.

It will be obvious to one skilled in the art that various factors must be considered in designing a successful practice of the method of the present invention. Factors which should be considered in designing such a practice are: injection rate of the carrier fluid; density contrast between the diverting agent and the carrier fluid; the degree of deviation of the wellbore, the diameter of the wellbore, the size of the diverting agent, viscosity of carrier fluid (especially for particulate materials), perforation flow rate, and the flow rate past the perforation for all of the perforations in the casing.

Laboratory Model Tests

The following results of laboratory tests are illustrative of the practice of the present invention. The tests were conducted in an acrylic wellbore deviated at various angles from the vertical. The wellbore had an inside diameter of six inches (15.24 cm.) and was provided with a plurality of one-half inch (1.27 cm.) diameter perforations.

Perforations Near Top of Casing—Wellbore Deviated 30°

In the first series of tests, the wellbore was deviated 30° from the vertical and provided with four (4) perforations. The perforations were positioned at the top of the casing within a plane aligned substantially in the vertical and extending along the longitudinal axis of the wellbore.

In the first set of tests, three-quarter inch (1.91 cm.) diameter buoyant balls having a density contrast (density of ball sealer minus the density of the carrier fluid) within the range of about $-0.084$ g/cm$^3$ to about $-0.004$ 5/cm$^3$ were transported down the wellbore to the perforated interval. Although the total flow rate down the casing was adjusted to transport the balls to the perforations, the perforation flow rate was maintained at about ½ gal/min (1.89 liters/min). The balls were transported down the top of the casing and all of the balls in this density contrast range seated on upper perforations, resulting in a 100% seating efficiency.

In a second group of tests, ¾" nonbuoyant balls were injected into the wellbore similarly oriented and outfitted with perforations. The results were as follows:

| Nonbuoyant Ball Sealer Density Contrast (g/cm$^3$) | Perforation Flow Rate (Gal/Min.) [Liters/Min.] | Seating Efficiency (%) |
|---|---|---|
| | 5.0 [18.9] | 0 |
| | 7.5 [28.4] | 15.0 |
| 0.002 | 10.0 [37.9] | 55.0 |
| | 12.5 [47.3] | 70.0 |
| | 15.0 [56.8] | 95.0 |
| | 7.5 [28.4] | 0 |
| 0.018 | 10.0 [37.9] | 0 |
| | 12.5 [47.3] | 0 |
| | 15.0 [56.8] | 0 |

Perforations Near Bottom of Casing—Wellbore Deviated 30°

In another series of tests, four perforations were positioned on both sides of the wellbore circumferentially spaced-away from the bottom of the wellbore at an angle of about 60°. In these tests the orientation (or deviation) of the wellbore model could be adjusted from 0° to 60° with respect to the vertical.

In the first phase of these tests, buoyant ball sealers were injected into the wellbore which was deviated 30° from the vertical. As in the previous test, balls were maintained within the perforated interval for a period of time by permitting flow out of the bottom of the wellbore. In this test configuration, one or more ball sealers seated under the following conditions: (a) density contrast $-0.079$ g/cm$^3$, perforation flow rate 6.3 gal/min. [22.7 l/min.] (5 minutes in interval); (b) density contrast $-0.016$ g/cm$^3$, perforation flow rate 5.0 gal/min. [18.9 l/min.] (3 minutes in interval); (c) density contrast $-0.004$ g/cm$^3$, perforation flow rate 5.5 gal/min. [2 minutes in interval]. However, no ball sealer seated on the perforations when the flowrates were decreased substantially below the conditions indicated.

In the final phase of this test (wellbore deviation 30° from vertical), nonbuoyant balls were injected into the wellbore and the following results were observed:

| Nonbuoyant Ball Sealer Density Contrast (g/cm$^3$) | Perforation Flow Rate (Gal/Min.) [Liters/Min.] | Seating Efficiency (%) |
|---|---|---|
| 0.002 | 1.25 [4.7] | 0 |
| | 5.00 [18.9] | 35 |
| | 10.00 [37.9] | 90 |
| | 15.00 [56.8] | 90 |
| 0.005 | 5.0 [18.9] | 0 |

-continued

| Nonbuoyant Ball Sealer Density Contrast (g/cm³) | Perforation Flow Rate (Gal/Min.) [Liters/Min.] | Seating Efficiency (%) |
|---|---|---|
| | 7.5 [25.4] | 15 |
| | 10.0 [37.9] | 39 |
| | 12.5 [47.3] | 80 |

Perforations Near Bottom of Casing—Wellbore Deviated 60°

In the final series of tests, four perforations were positioned on both sides of the wellbore circumferentially spaced-away from the bottom of the wellbore at an angle of about 60°. The wellbore model was deviated 60° from the vertical.

In the first phase of this test buoyant ball sealers were injected into the wellbore and maintained within the perforated interval for a period of time by permitting flow out of the bottom of the wellbore. One or more ball sealers seated under the following conditions: (a) density contrast −0.018 g/cm³, perforation flow rate 15 gal/min. [56.8 l/min.] (2 minutes in interval); (b) density contrast −0.012 g/cm³, perforation flow rate 10 gal/min. [37.9 l/min.] (2 minutes in interval); (c) density contrast −0.004 g/cm³, perforation flow rate 5 gal/min. [3 minutes in interval]. However, no ball sealer seated on the perforations when the density contrast was increased to −0.026 g/cm³ even though the perforation flow rate was increased to over 15 gal/min. [56.8 l/min.] per perforation.

In the final phase of this test, nonbuoyant balls were injected into the 60° deviated wellbore with the following results:

| Nonbuoyant Ball Sealer Density Contrast (g/cm³) | Perf. Flow Rate (Gal/Min.) [Liters/Min.] | Seating Efficiency (%) |
|---|---|---|
| 0.002 | 1.25 [4.7] | 5 |
| | 5.00 [18.9] | 65 |
| | 10.00 [37.9] | 85 |
| | 15.00 [56.8] | 95 |
| 0.018 | 2.5 [9.5] | 0 |
| | 5.0 [18.9] | 0 |
| | 7.5 [28.4] | 10 |
| | 10.0 [37.9] | 15 |
| | 12.5 [47.3] | 15 |
| | 15.0 [56.3] | 25 |

It is obvious that the method of the present invention will only be operative on wellbores which are deviated from the vertical. The greater the deviation of the wellbore, the greater likelihood of success in performing the method. In cases where it is known that selective diversion will be desired, it is desirable to directionally drill the wellbore to have a deviated angle of preferably about 25° or more from the vertical.

While embodiments and applications of the method of the present invention have been shown and described, it will be apparent to those skilled in the art that many more modifications are possible without departing from the inventive concepts herein described. The invention, therefore, is not to be restricted except as is necessary by the prior art and by the spirit of the appended claims.

I claim:

1. A method of selectively sealing perforations in a deviated well casing comprising the steps of:

perforating a first portion of said casing with a first plurality of perforations where substantially all of said perforations are positioned abutting a plane aligned substantially in the vertical and extending along the longitudinal axis of said casing;

perforating a second portion of said casing with a second plurality of perforations where substantially all of said perforations are circumferentially spaced-away from said plane at a distance sufficient to substantially prevent diverting agents being transported down said casing in carrier fluid in a pathway adjacent to said casing and to said plane, from seating in said perforations;

injecting into said casing a carrier fluid containing diverting agents selected from the group consisting of diverting agents having a density greater than that of the carrier fluid and diverting agents having a density less than that of the carrier fluid;

transporting said diverting agents in said carrier fluid down said casing to said first portion of said casing, and flowing said carrier fluid into said first plurality of perforations to cause said diverting agents to selectively seat in said first plurality of perforations.

2. The method of claim 1 wherein said diverting agents are ball sealers.

3. The method of claim 1 wherein said diverting agents are particulate materials.

4. A method of selectively sealing perforations in a deviated well casing comprising the steps of:

perforating a first portion of said casing with a first plurality of perforations where substantially all of said perforations are positioned abutting a plane aligned substantially in the vertical and extending along the longitudinal axis of said casing;

perforating a second portion of said casing with a second plurality of perforations where substantially all of said perforations are circumferentially spaced-away from said plane at a distance sufficient to substantially prevent ball sealers being transported down said casing in carrier fluid in a pathway adjacent to said casing and to said plane, from seating on said perforations;

injecting into said casing a carrier fluid containing ball sealers selected from the group consisting of ball sealers having a density greater than that of the carrier fluid and ball sealers having a density less than that of the carrier fluid;

transporting said ball sealers in said carrier fluid down said casing to first portion of said casing along a pathway adjacent to said casing and to said plane; and flowing said carrier fluid into said first plurality of perforations to cause said ball sealers to selectively seat on said first plurality of perforations.

5. The method of claim 4 where said second plurality of perforations are circumferentially spaced-away from said vertical plane at an angle of at least about 30°.

6. A method of claim 4 where said second plurality of perforations are circumferentially spaced-away from said vertical plane at an angle of at least about 60°.

7. A method of selectively sealing perforations in a deviated well casing comprising the steps of:

perforating a first portion of said casing with a first plurality of perforations where substantially all of said perforations are positioned at the top of said casing abutting a plane aligned substantially in the vertical and extending along the longitudinal axis of said casing;

perforating a second portion of said casing with a second plurality of perforations where substantially all of said perforations are positioned at the bottom of said casing abutting a plane aligned substantially in the vertical and extending along the longitudinal axis of said casing;

injecting into said casing a carrier fluid containing ball sealers having a density less than that of the carrier fluid;

transporting said ball sealers down the casing along a pathway positioned adjacent to the top of said casing; and flowing said carrier fluid into said first plurality of perforations to cause said ball sealers to selectively seat on said first plurality of perforations.

8. A method of selectively sealing perforations in a deviated well casing comprising the steps of:

perforating a first portion of said casing with a first plurality of perforations where substantially all of said perforations are positioned at the top of said casing abutting a plane aligned substantially in the vertical and extending along the longitudinal axis of said casing;

perforating a second portion of said casing with a second plurality of perforations where substantially all of said perforations are positioned at the bottom of said casing abutting a plane aligned substantially in the vertical and extending along the longitudinal axis of said casing;

injecting into said casing a carrier fluid containing ball sealers having a density greater than that of the carrier fluid;

transporting said ball sealers down the casing along a pathway positioned adjacent to the bottom of said casing; and flowing said carrier fluid into said second plurality of perforations to cause said ball sealers to selectively seat on said second plurality of perforations.

9. A method of selectively sealing perforations in a deviated well casing comprising the steps of:

perforating a first portion of said casing with a first plurality of perforations where substantially all of said perforations are positioned within the vertical plane extending along the longitudinal axis of said casing;

perforating a second portion of said casing with a second plurality of perforations where substantially all of said perforations are circumferentially spaced-away from said vertical plane at an angle of at least about 30°;

injecting into said casing a carrier fluid containing ball sealers selected from the group consisting of ball sealers having a density greater than that of the carrier fluid and ball sealers having a density less than that of the carrier fluid;

transporting said ball sealers in said carrier fluid down said casing to said first portion of said casing; and flowing said carrier fluid through said first plurality of perforations to cause said ball sealers to seat on said first plurality of perforations.

10. A method of selectively sealing perforations in a deviated well casing comprising the steps of:

perforating a first portion of said casing with a first plurality of perforations where substantially all of said perforations are positioned at the top of said casing abutting a plane aligned substantially in the vertical and extending along the longitudinal axis of said casing;

perforating a second portion of said casing with a second plurality of perforations where substantially all of said perforations are circumferentially spaced-away from said plane at the top of said casing at an angle of at least about 30°;

injecting into said casing a carrier fluid containing diverting agents having a density less than that of the carrier fluid;

transporting said diverting agents down the casing along a pathway adjacent to the top of said casing; and flowing said carrier fluid into said first plurality of perforations to cause said diverting agents to selectively seat on said first plurality of perforations.

11. A method of selectively sealing perforations in a deviated well casing comprising the steps of:

perforating a first portion of said casing with a first plurality of perforations where substantially all of said perforations are positioned at the bottom of said casing abutting a plane aligned substantially in the vertical and extending along the longitudinal axis of said casing;

perforating a second portion of said casing with a second plurality of perforations where substantially all of said perforations are circumferentially spaced-away from said plane at the bottom of said casing at an angle of at least about 30°;

injecting into said casing a carrier fluid containing diverting agents having a density greater than that of the carrier fluid;

transporting said diverting agents down the casing along a pathway adjacent to the bottom of said casing; and flowing said carrier fluid into said first plurality of perforations to cause said diverting agents to selectively seat on said first plurality of perforations.

* * * * *